US012545472B2

(12) United States Patent
Tsao

(10) Patent No.: US 12,545,472 B2
(45) Date of Patent: Feb. 10, 2026

(54) BEVERAGE CARRYING CARD APPLICABLE TO CUPS OF VARIOUS SIZES

(71) Applicant: Chung-Piao Tsao, Taipei (TW)

(72) Inventor: Chung-Piao Tsao, Taipei (TW)

( * ) Notice: Subject to any disclaimer, the term of this patent is extended or adjusted under 35 U.S.C. 154(b) by 0 days.

(21) Appl. No.: 18/732,623

(22) Filed: Jun. 4, 2024

(65) Prior Publication Data

US 2025/0368384 A1 Dec. 4, 2025

(51) Int. Cl.
*B65D 5/489* (2006.01)
*B65D 71/62* (2006.01)

(52) U.S. Cl.
CPC ..... *B65D 5/4802* (2013.01); *B65D 71/004* (2013.01); *B65D 2571/00265* (2013.01); *B65D 2571/0066* (2013.01)

(58) Field of Classification Search
CPC ..... B65D 5/48; B65D 5/4802; B65D 71/00; B65D 71/004; B65D 71/46; B65D 71/48; B65D 71/60; B65D 2571/00265; B65D 2571/0066; B65D 71/40; B65D 71/42; B65D 71/44
USPC ..... 206/151, 158, 175, 194, 195–197; 294/87.2
See application file for complete search history.

(56) References Cited

U.S. PATENT DOCUMENTS 4,196,807 A * 4/1980 Brom ..... B65D 71/0007 294/87.2
5,267,644 A * 12/1993 Tsao ..... B65D 71/48 294/87.2
5,738,217 A * 4/1998 Hunter ..... B65D 71/48 206/427
6,802,802 B2 * 10/2004 Woog ..... B65D 71/36 206/427
8,087,511 B2 * 1/2012 Libit ..... B65D 71/0074 206/162
8,739,503 B2 * 6/2014 Smith ..... B65D 71/48 53/443

* cited by examiner

*Primary Examiner* — Bryon P Gehman
(74) *Attorney, Agent, or Firm* — Leong C. Lei

(57) ABSTRACT

A beverage carrying card includes a board including a central portion, two sidewall portions connected to two opposite sides of the central portion, and two handle portions respectively connected to the sidewall portions at another side thereof. A fold line is arranged between the central portion and each of the sidewall portions and between each of the handle portions and each of the sidewall portions. The central portion is formed with at least one through hole. Each handle portion is formed with a handle opening. Each handle opening is connected with a hook-up plate for combining the handle portions together. One end of each handle portion that is adjacent to the sidewall portion has a length shorter than that of the sidewall portion. A waterproof pearly layer is combined on a surface of the board and is formed with a waterproof pearly through hole to correspond to the through hole.

9 Claims, 11 Drawing Sheets

BEVERAGE CARRYING CARD APPLICABLE TO CUPS OF VARIOUS SIZES

BACKGROUND OF THE INVENTION

(a) Technical Field of the Invention

The present invention relates to a beverage carrying card, and more particularly to a beverage carrying card applicable to cups of various sizes, which is capable of preventing the beverage carrying card from absorbing water droplets condensed on the outside of a beverage cup and becoming softened to lose strength thereof.

(b) Description of the Prior Art

In order to make it easy to carry beverages, various cup holder products are available in the market. With the rise of environmental awareness, more and more cup holder products are made by folding carboards to provide both functions of cup holder and carrying handle. An example is a known carrying card A shown in FIG. 1, which allows a user to carry and move cups in the way shown in FIG. 2. However, usually two conventional through holes A1 of such a product are of the same size. When the user purchases one high cup and one low cup that are carried as shown in FIG. 2, if the known carrying card A is directly placed on a table B, the high cup D will touch the table B first and a top thereof will get stuck on the carrying handle A3, making it impossible to separate the known carrying card A from the high cup D. Under this condition, as shown in FIG. 3, the low cup D becomes tilted and cannot contact the table B in a horizontal condition. The low cup D being tilted induces a rotational torque that may readily cause the two cups D to overturn, causing safety risk. If the known carrying card A is formed, in advance, with through holes A1 of different sizes to match the heights of different cups D, shareability of materials might be greatly limited, easily resulting in a waste of resources.

If the cups D holds cold beverages, water droplets E may condense on the outside due to low temperature. Such water droplets E, upon contacting the cardboard of the carrying card A, will be absorbed, making the cardboard softened and losing strength, so that the weight of the cups D may cause damage to the known carrying card A while being carried by the user. Even if the carrying card A has been treated with film lamination, the through holes A1 are usually punched with tools after the film lamination processing, so that the hole walls of the through holes A1 are not covered by the laminated film, and water droplets E can still penetrate into the known carrying card A through the hole walls of the through holes A1.

SUMMARY OF THE INVENTION

The primary objective of the present invention is to provide a beverage carrying card that is applicable to cups of various sizes, in which a handle portion is reduced to allow the present invention to receive and hold cups of different heights without potential risk of tilting when placed and also including a waterproof pearly layer that is suspended over a hole wall of a through hole to prevent, when a cup placed in the present invention, the cup from directly contacting a cardboard, so that water droplets on the surface of the cup does not contact with the cardboard to prevent the cardboard from getting softened and losing strength due to absorbing the water droplets.

To achieve the above objective, the present invention provides a beverage carrying card that is applicable to cups of various sizes, comprising a board, which comprises a central portion, two sidewall portions respectively connected to two opposite sides of the central portion, and two handle portions respectively connected to the sidewall portions at one side that is opposite to the central portion, a fold line being arranged between the central portion and each of the sidewall portions, a fold line being formed between each of the handle portions and a respective one of the sidewall portions, the central portion being formed with at least one through hole, each of the handle portions being formed with a handle opening, each of the handle openings being connected through a fold line to a hook-up plate, each of the hook-up plates being formed with a hook-up notch to allow the hook-up plates to hook up with each other to combine the handle portions together, each of the handle portions having one end that is adjacent to a respective one of the sidewall portions and has a length shorter than a length of the respective one of the sidewall portions; and a waterproof pearly layer, which is combined with one surface of the board, the waterproof pearly layer being formed, at a location corresponding to the through hole, with at least one waterproof pearly through hole, the waterproof pearly through hole having a hole diameter that is smaller than a hole diameter of the through hole, so that a portion of the waterproof pearly layer is suspended over a hole wall of the through hole.

The board is made by cutting a cardboard, and the waterproof pearly layer can be made of polyethylene (PE) or polypropylene (PP). The through hole is of a circular shape, and the waterproof pearly through hole is of a circular shape that is concentric with the through hole. In an arrangement where a plurality of through holes are provided, the through holes are arranged in a lengthwise direction of the central portion and the through holes are of the same size, so that the present invention is allow to accommodate, at the same time, two to four, or even ore beverage cups.

The length of one end of the handle portions that is adjacent to a respective one of the sidewall portions is shorter than that of the sidewall portion, so that when two handle portions are combined together by means of the hook-up plates, there is an additional space above the cups. In one embodiment, the present invention, in case of receiving and holding a high and a low cups therein, is placeable on a tabletop, such that a top of the high cup is not stuck by each of the handle portions to allow the high cup to smoothly separate from the present invention, while the low cup can be moved downward with the present invention to allow the low cup to be placed, in a horizontal manner, on the tabletop, avoiding the potential risk of overturning.

To increase the lengths of the handle portions and the handle openings in order to be held by users having different types of hands, the length of each of the handle portions can be gradually increased from the one end that is adjacent to the respective one of the sidewall portions toward an opposite end, so that the length of the handle opening is not limited by the length of the one end of the handle portion that is adjacent to the respective one of the sidewall portions.

The waterproof pearly layer is combined with a top surface of the board. To use the present invention, cups are first placed at locations corresponding to the waterproof pearly through holes, and the present invention is lifted up so that the portions of the waterproof pearly layer that are suspended over the through holes are caused to flex downward as being acted upon by the weights of the cups. Since a length of the portion of the waterproof pearly layer that is suspended over the through hole can be made greater than a thickness of the board, the downward flexed portion of the waterproof pearly layer can completely cover and shield the hole wall of the through hole and setting the waterproof pearly layer between the cup and the board to isolate the hole wall of the through hole from being contacted by the cup, and as such, water droplets condense on the outside of the cup may not be absorbed by the board.

To avoid breaking occurring at the handle openings when the present invention is being carried by a user, a backward folded reinforcement portion is arranged between one end of each of the handle portions that is opposite to the respective one of the sidewall portions and the handle opening. The backward folded reinforcement portion provides reinforcement at an upper side of the handle openings that are assembled together. Each of the handle portions is formed with two lanyard apertures, and the lanyard apertures are respectively set at two sides of the handle opening. The lanyard apertures are each combinable with a lanyard to allow a user to hang the present invention on a hanging frame of a bicycle or a motorcycle by means of the lanyards.

DETAILED DESCRIPTION OF THE PREFERRED EMBODIMENTS

Figure 1:
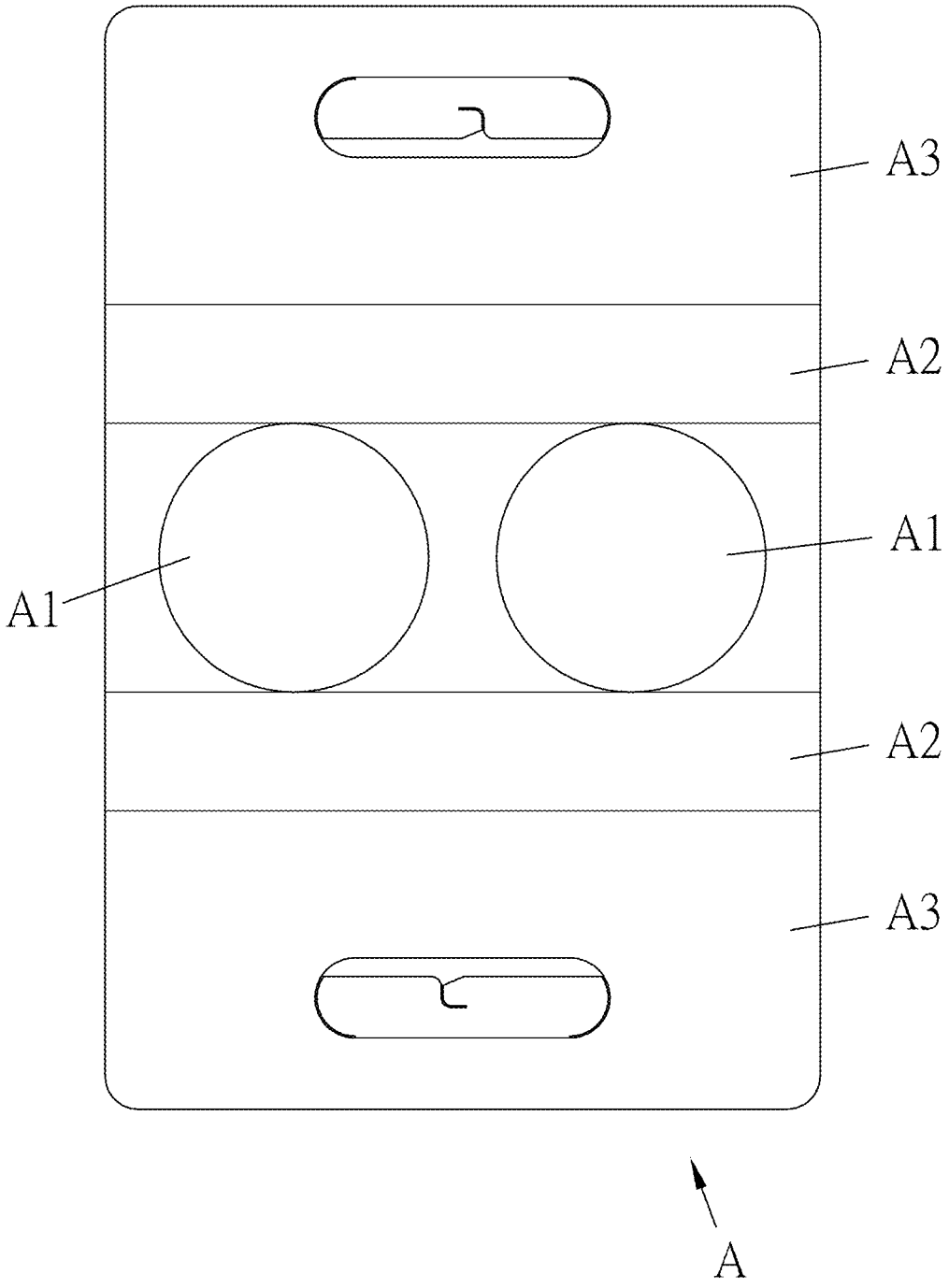
FIG. 1 PRIOR ART
FIG. 1 is a top plan view showing a prior art beverage carrying card.
Figure 2:
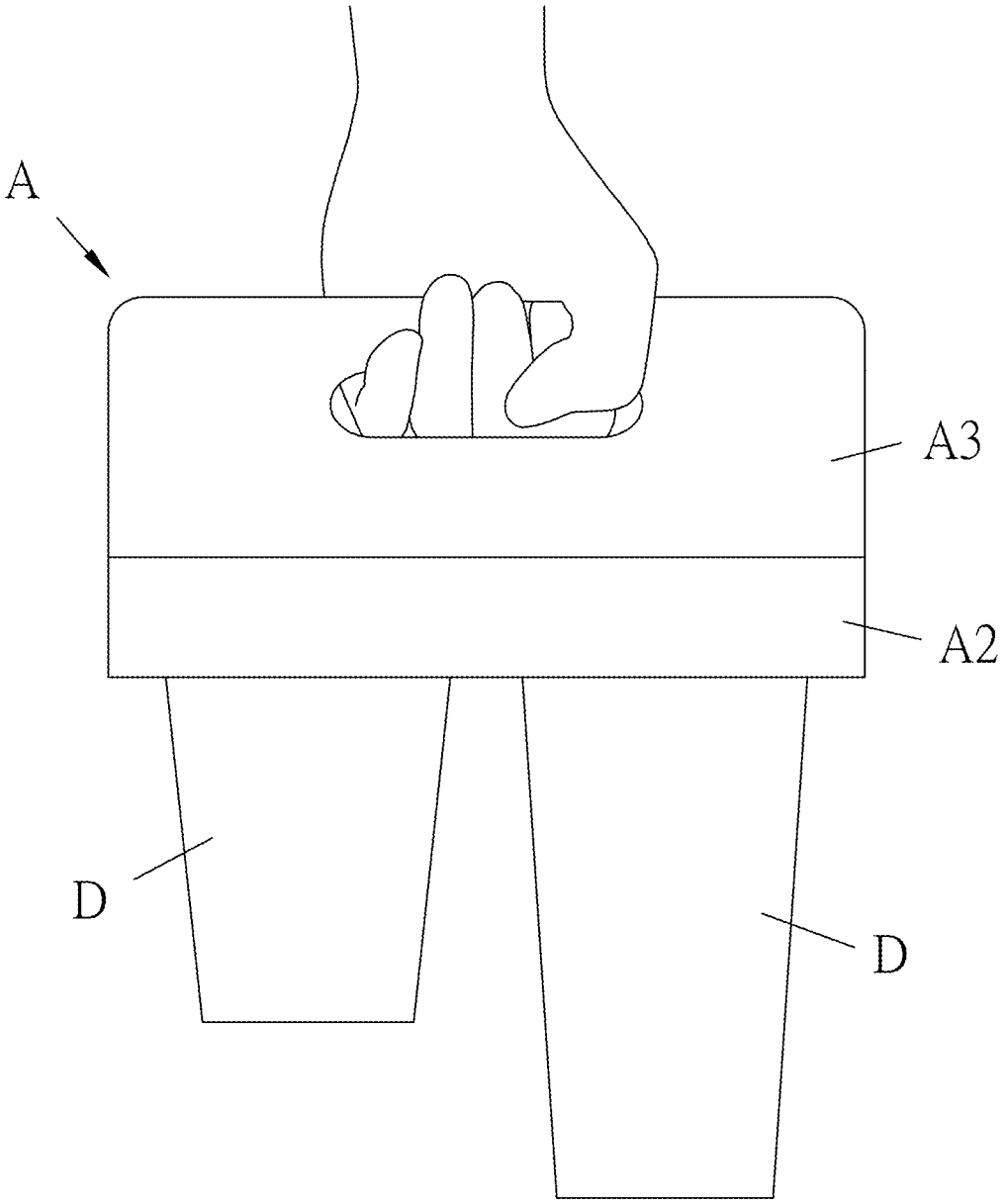
FIG. 2 PRIOR ART
FIG. 2 is a schematic view showing a way of use of the prior art beverage carrying card.
Figure 3:
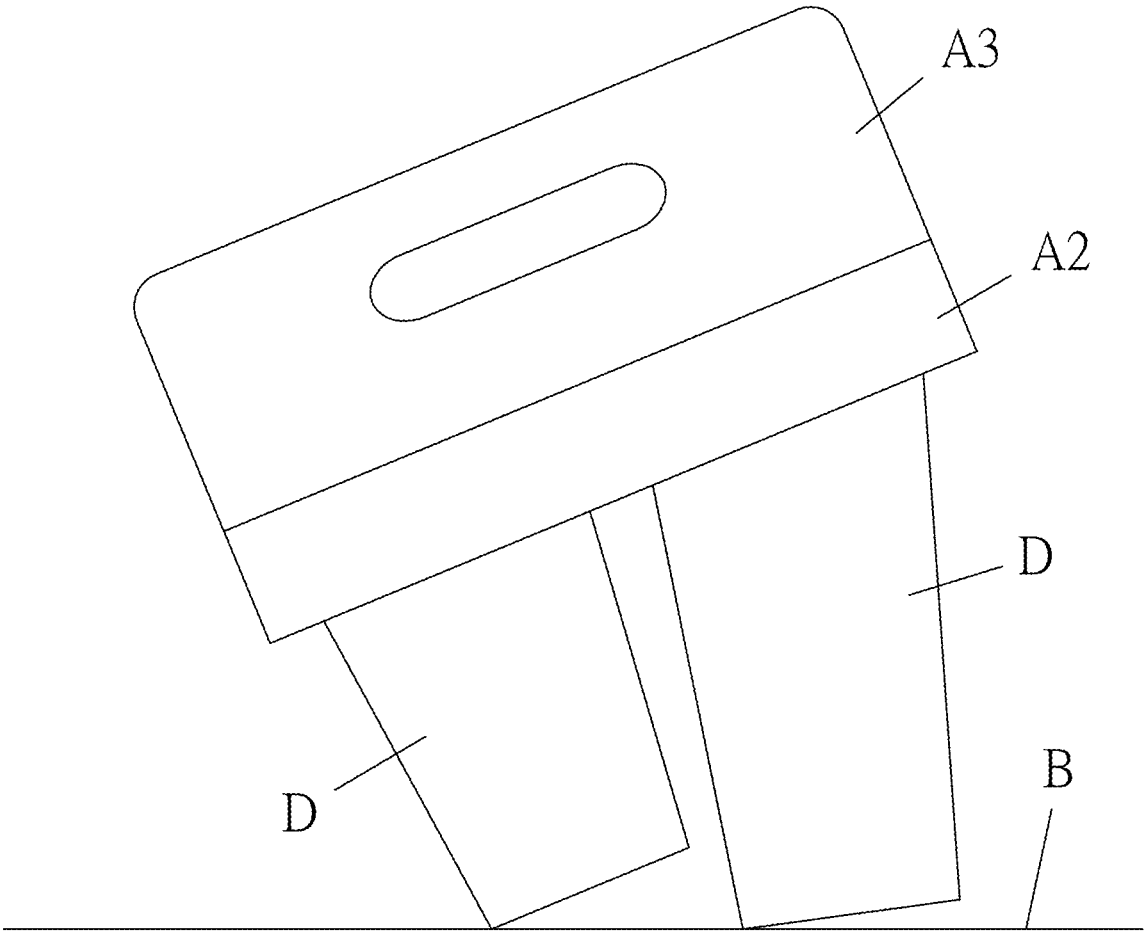
FIG. 3 PRIOR ART
FIG. 3 is another schematic view showing the way of use of the prior art beverage carrying card.
Figure 4:
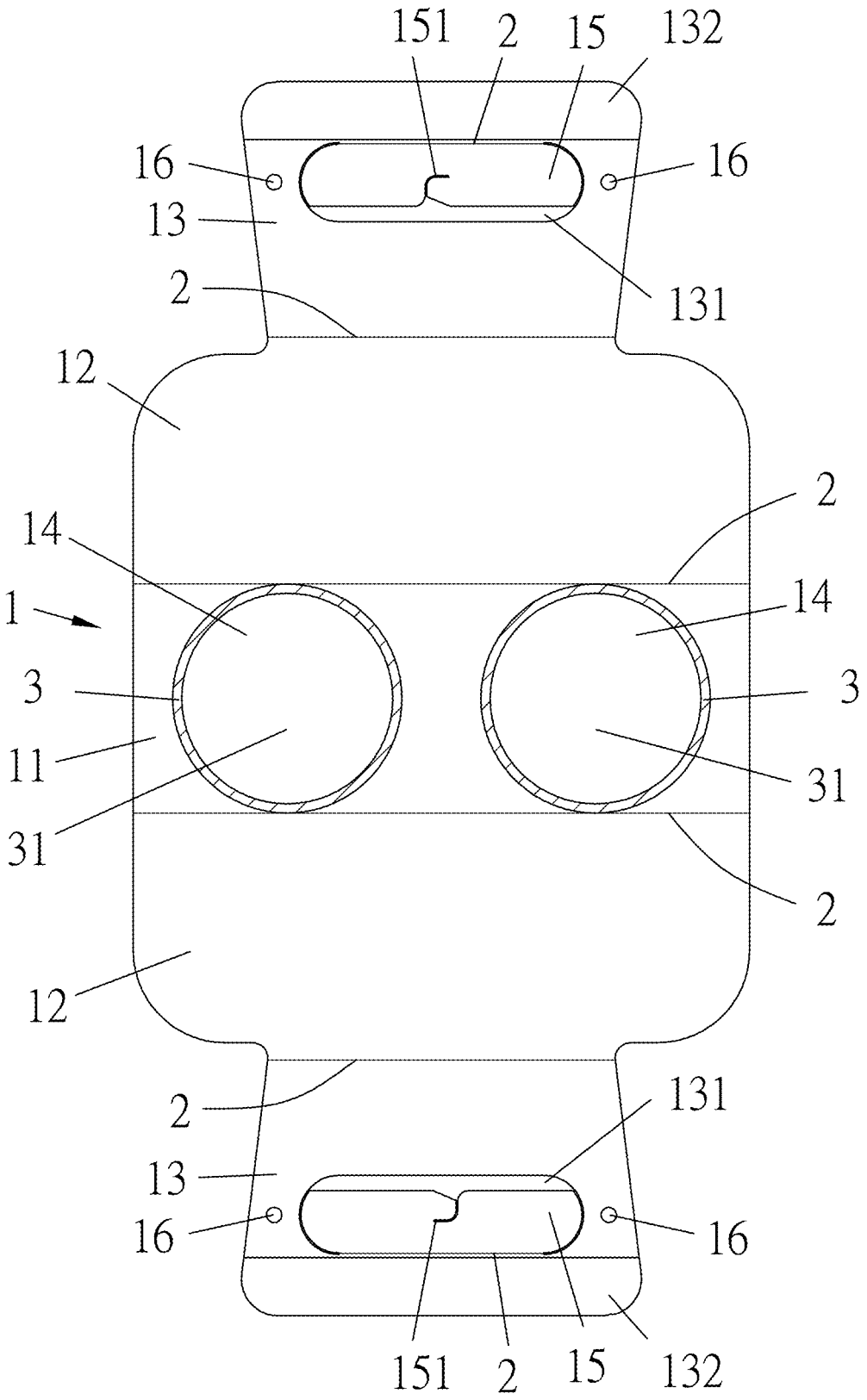
FIG. 4 is a top plan view of the present invention.
Figure 5:
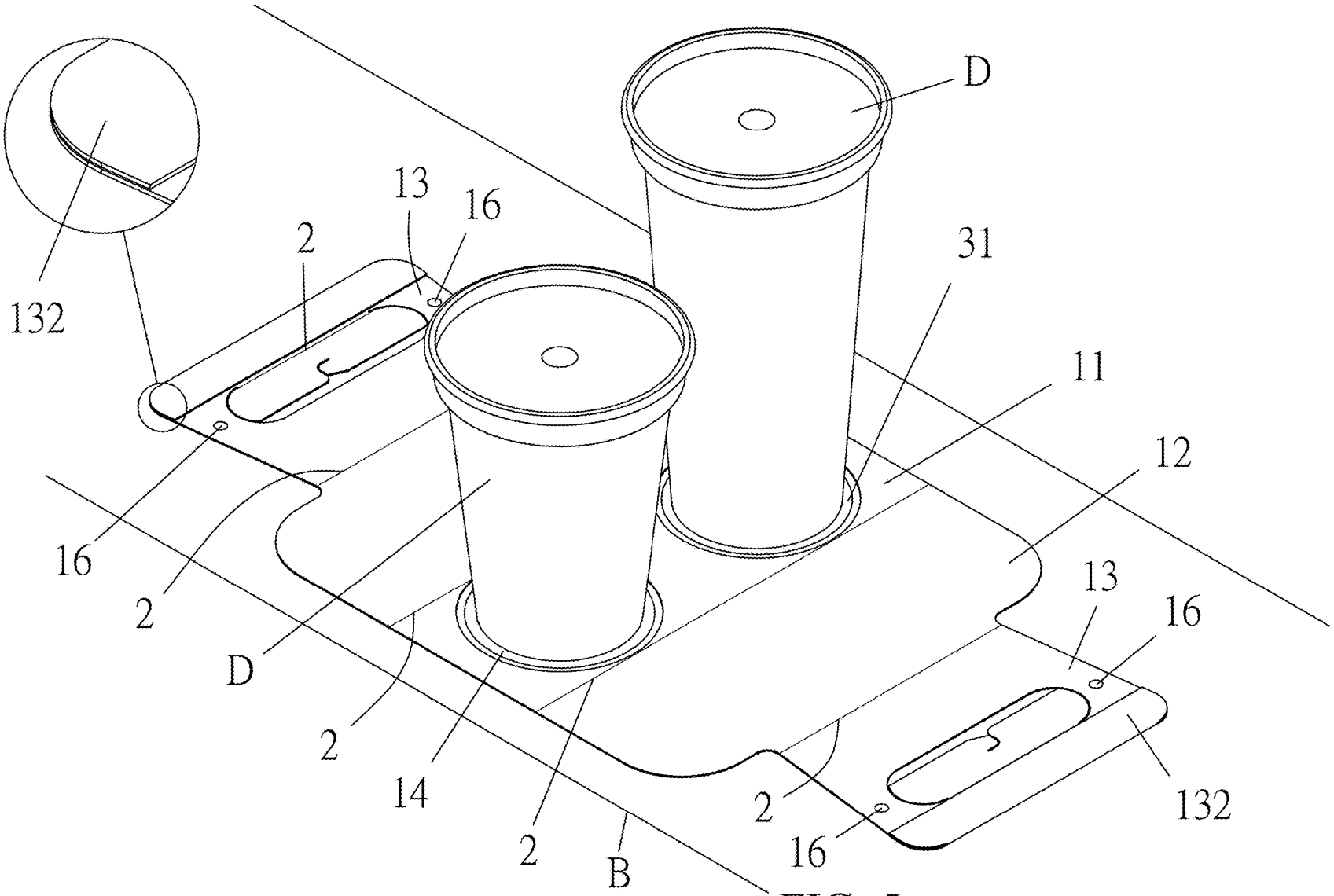
FIG. 5 is a first schematic view showing a step of use of the present invention.
Figure 6:
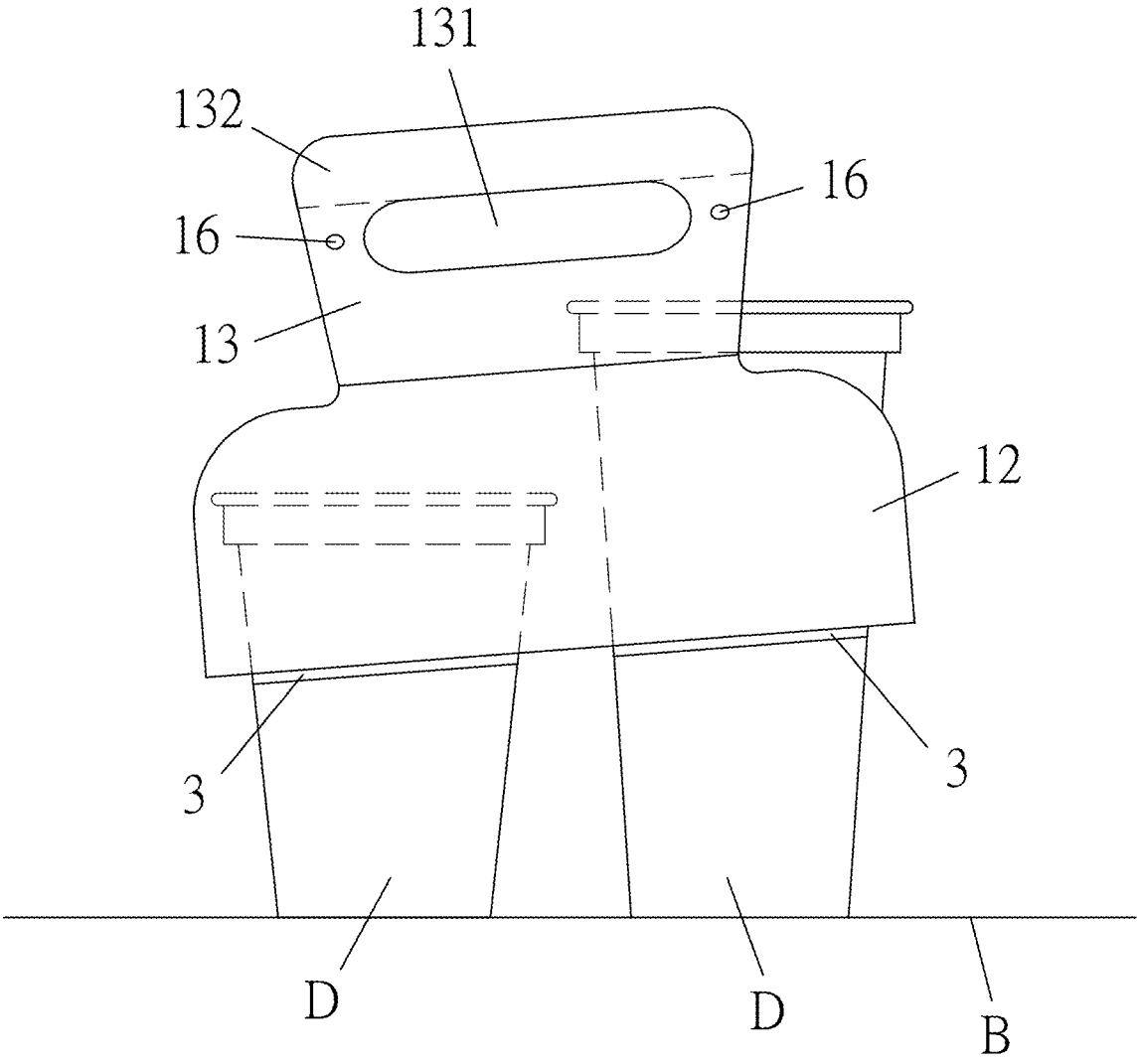
FIG. 6 is a second schematic view showing the step of use of the present invention.
Figure 7:
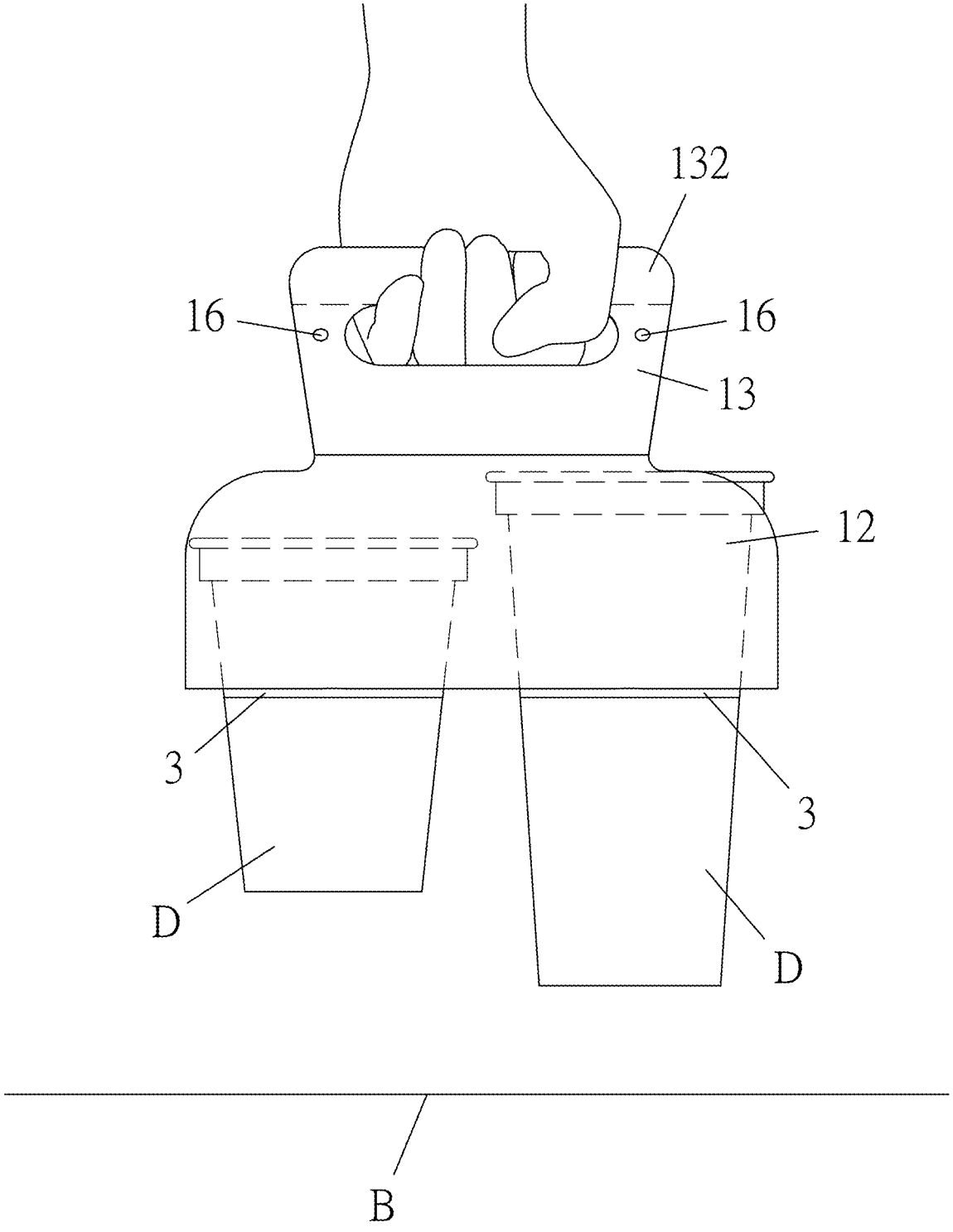
FIG. 7 is a third schematic view showing the step of use of the present invention.
Figure 8:
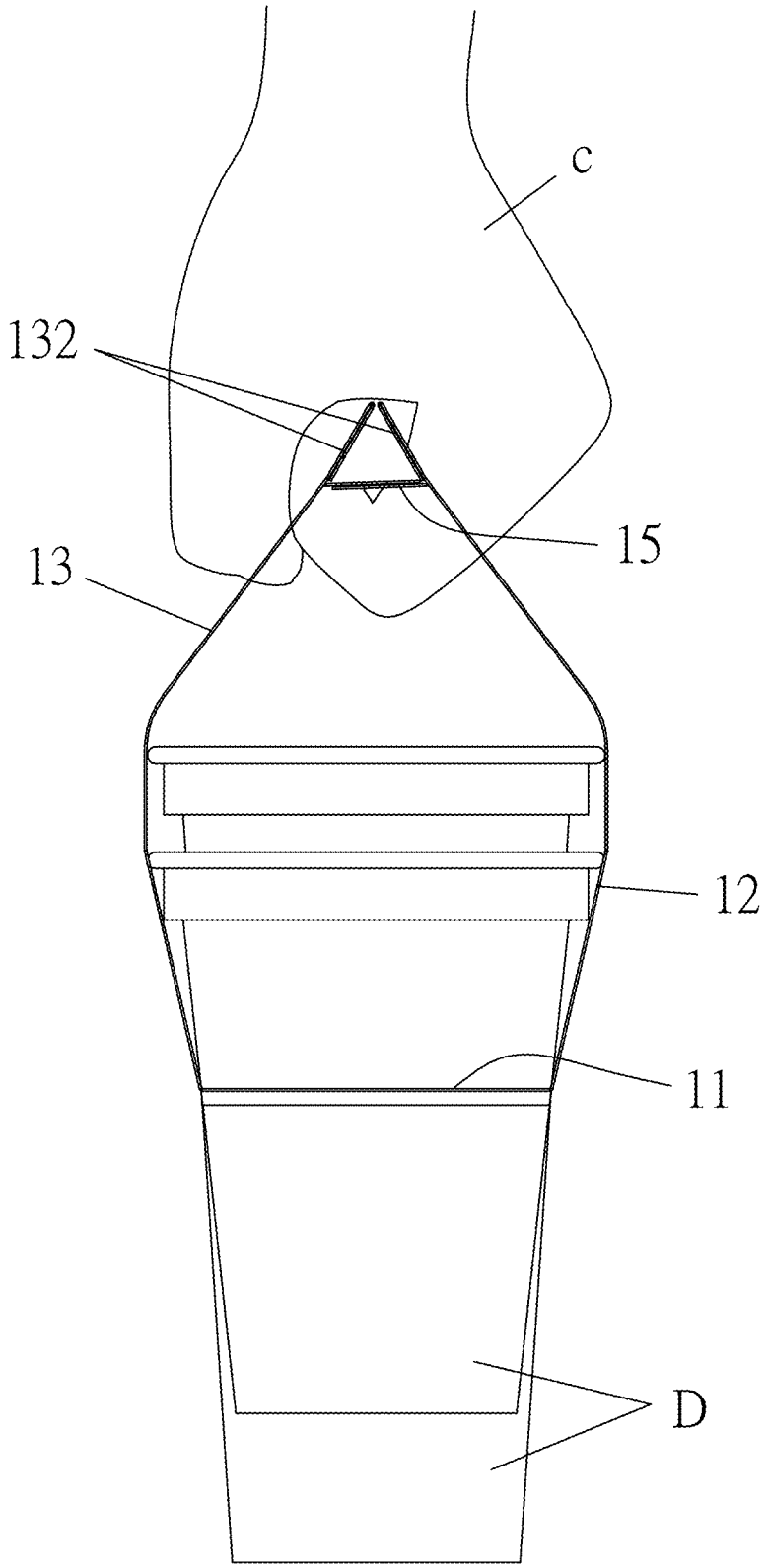
FIG. 8 shows a different angle of FIG. 7.
Figure 9:
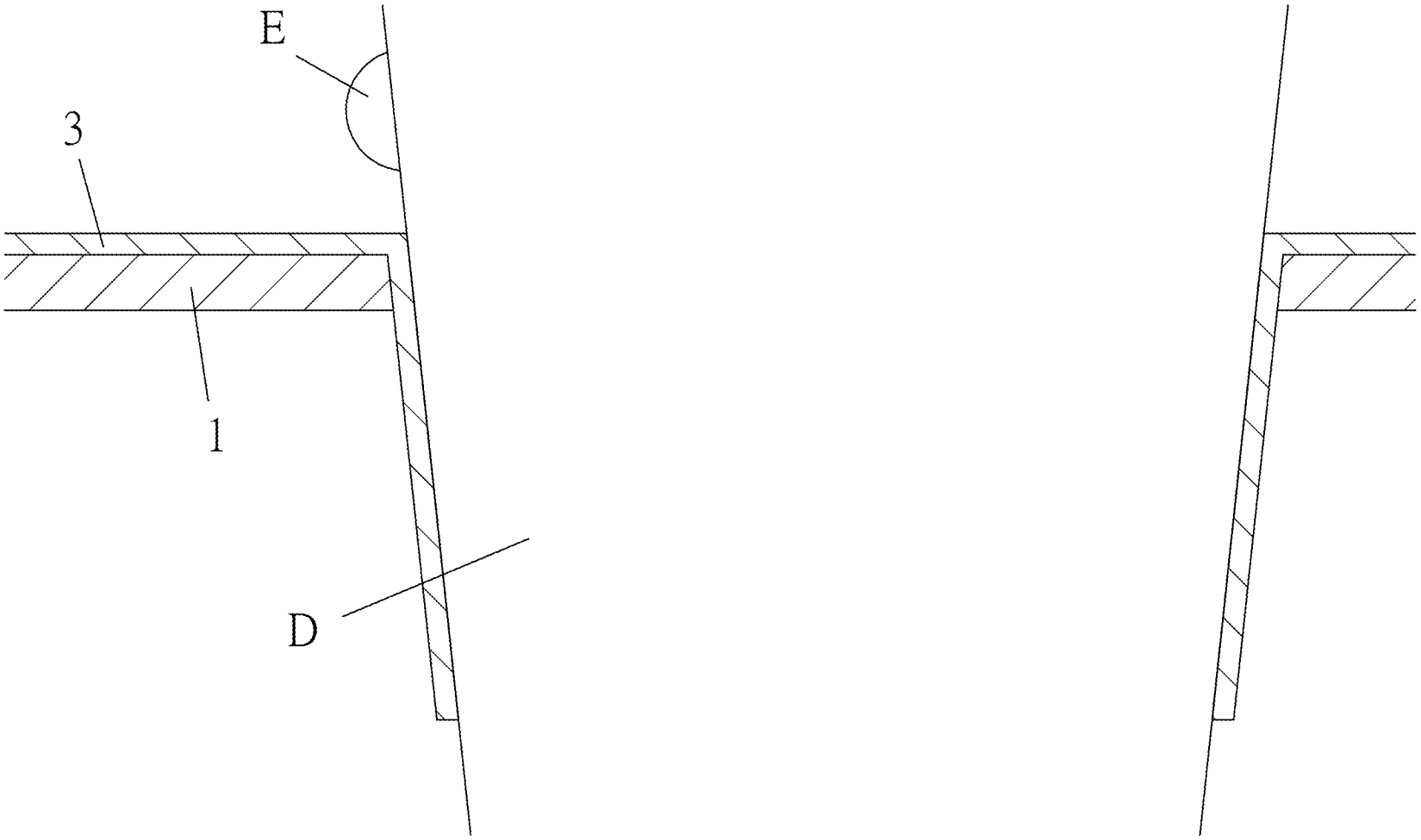
FIG. 9 is a cross-sectional view showing a portion of FIG. 7.

Referring to FIG. 4, which is a drawing depicting an embodiment of the present invention, the present invention provides a beverage carrying card applicable to cups of various sizes, which will be described with reference to the drawing, comprising a board 1, which comprises a central portion 11, two sidewall portions 12 respectively connected to two opposite sides of the central portion 11, and two handle portions 13 respectively connected to the sidewall portions 12 at one side that is opposite to the central portion 11, wherein a fold line 2 is arranged between the central portion 11 and each of the sidewall portions 12, and a fold line 2 is arranged between each of the handle portions 13 and a respective one of the sidewall portions 12, and the central portion 11 is formed with at least one through hole 14, and each of the handle portions 13 is formed with a handle opening 131, and each of the handle openings 131 is connected through a fold line 2 to a hook-up plate 15 and each of the hook-up plates 15 is formed with a hook-up notch 151 to allow the hook-up plates 15 to hook up with each other to combine the handle portions 13 together, and each of the handle portions 13 has one end that is adjacent to a respective one of the sidewall portions 12 and has a length that is shorter than a length of the respective one of the sidewall portions 12; and a waterproof pearly layer 3, which is combined with a surface of the board 1, wherein the waterproof pearly layer 3 is formed, at a location corresponding to the through hole 14, with at least one waterproof pearly through hole 31 and the waterproof pearly through hole 31 has a hole diameter that is smaller than a hole diameter of the through hole 14, so that a portion of the waterproof pearly layer 3 is suspended over a hole wall of the through hole 14 (where a portion of a film of the waterproof pearly layer 3 that is suspended over the through hole 14 is illustrated as a hatched portion in FIG. 4).

In the instant embodiment, the board 1 is made by cutting a cardboard, and the waterproof pearly layer 3 can be made of polyethylene (PE) or polypropylene (PP). The through hole 14 is of a circular shape, and the waterproof pearly through hole 31 is of a circular shape that is concentric with the through hole 14. In the instant embodiment, two through holes 14 are provided, and the through holes 14 are arranged in a lengthwise direction of the central portion 11 and the through holes 14 are of the same size. The present invention allows cups D of different heights to be carried with through holes 14 of the same without causing potential risk of tilting, and as such, the manufacturers do not need to make through holes 14 of different sizes in the same carrying card in order to allow a user to carry cups D of different heights. The number of the through holes 14 and that of the waterproof pearly through holes 31 can be further increased to allow the present invention to accommodate two, three, four, or even more cups D, and the through holes 14 can be arranged to line up straight or they can be arranged in parallel lines.

The length of the one end of the handle portions 13 adjacent to the respective one of the sidewall portions 12 is shorter than the sidewall portion 12. To increase the lengths of the handle portions 13 and the handle openings 131 in order to be held by users having different types of hands, the length of each of the handle portions 13 can be gradually increased from the one end that is adjacent to the respective one of the sidewall portions 12 toward an opposite end, so that the length of the handle opening 131 is not limited by the length of the one end of the handle portion 13 that is adjacent to the respective one of the sidewall portions 12. In the instant embodiment, each of the handle portions 13 is formed with two lanyard apertures 16, and the lanyard apertures 16 are respectively set at two sides of the handle opening 131. The lanyard apertures 16 are each combinable with a lanyard F.

To avoid breaking occurring at the handle openings 131 when the present invention is being carried by a user, a backward folded reinforcement portion 132 is arranged between one end of each of the handle portions 13 that is opposite to the respective one of the sidewall portions 12 and the handle opening 131, so as to provide reinforcement at an upper side of the handle openings 131 that are assembled together. The backward folded reinforcement portion 132 can be formed by folding backward and adhering a portion of material that is kept during cutting of the board 1.

In the instant embodiment, the waterproof pearly layer 3 is combined with a top surface of the board 1. As shown in FIGS. 5-9, to use the present invention, cups D are first placed at locations corresponding to the waterproof pearly through holes 31, and the present invention is lifted up so that the portions of the waterproof pearly layer 3 that are suspended over the through holes 14 are caused to flex downward as being acted upon by the weights of the cups D. Since a length of the portion of the waterproof pearly layer 3 that is suspended over the through hole 14 can be made greater than a thickness of the board 1, the downward flexed portion of the waterproof pearly layer 3 can completely cover and shield the hole wall of the through hole 14 and setting the waterproof pearly layer 3 between the cup D and the board 1 to isolate the hole wall of the through hole 14 from being contacted by the cup D, and as such, water droplets E condense on the outside of the cup D that hold cold beverage may not be absorbed by the board 1, and the board 1 does not weaken due to absorbing water and does not lose the strength thereof, thereby reducing the potential risk that the present invention may become broken. Afterwards, the sidewall portions 12 and the handle portions 13 are each folded inward to allow the hook-up plates 15 to engage with each other and hooked tougher by means of the hook-up notches 151, and as such, the handle portions 13 on the two sides are closely combined together to allow a hand C of a user to firmly grip the present invention through the handle openings 131 for carrying the cups D to move.

Figure 10:
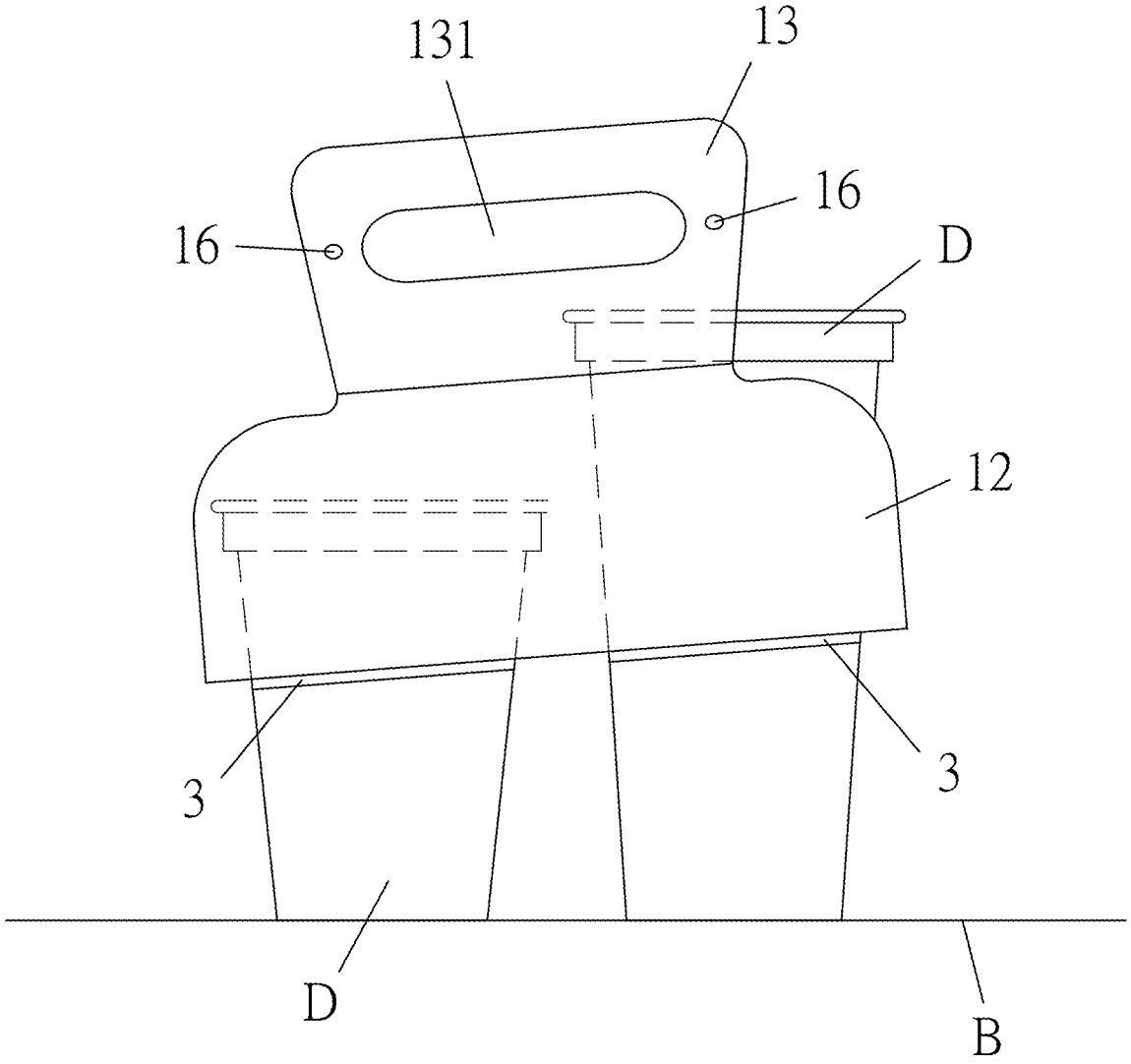
FIG. 10 is a fourth schematic view showing the step of use of the present invention.

FIG. 10 shows that the user, upon reaching a predetermined site, may place the present invention that holds a high and a low cups D on a tabletop B, where a top of the high cup D does not get stuck by the handle portions 13 and is allowed to protrude upward so that the high cup D can be smoothly separated from the present invention, and the present invention may then be moved downward together with the low cup D to allow the low cup D to be placed, in a horizontal manner, on the tabletop B, avoiding the potential risk of turning over.

Figure 11:
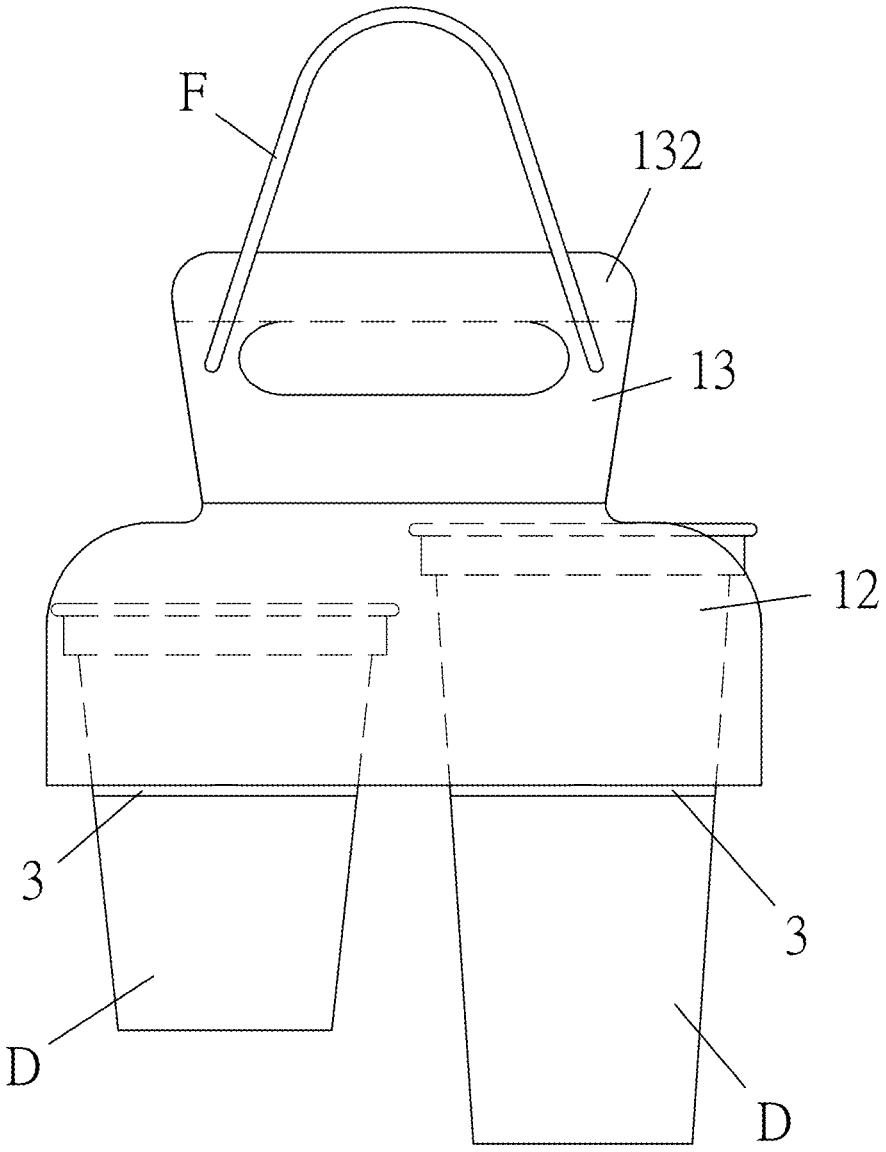
FIG. 11 is a schematic view showing use of another embodiment according to the present invention.

FIG. 11 shows, in the instant embodiment, each of the lanyard apertures 16 is connected to a lanyard F, to allow a user to hang the present invention on a hanging frame of a bicycle or a motorcycle (not shown in the drawings) by means of the lanyards F.

I claim:

1. A beverage carrying card applicable to cups of various sizes, comprising:

a board, which comprises a central portion, two sidewall portions respectively connected to two opposite sides of the central portion, and two handle portions respectively connected to the sidewall portions at one side that is opposite to the central portion, a fold line being arranged between the central portion and each of the sidewall portions, a fold line being formed between each of the handle portions and a respective one of the sidewall portions, the central portion being formed with at least one through hole, each of the handle portions being formed with a handle opening, each of the handle openings being connected through a fold line to a hook-up plate, each of the hook-up plates being formed with a hook-up notch to allow the hook-up plates to hook up with each other to combine the handle portions together, each of the handle portions having one end that is adjacent to and foldably connected at the fold line to its respective one of the sidewall portions and has a length along the foldable connection shorter than a length of the respective one of the sidewall portions to form an increase in length of the handle portion between the one end of the handle portion and an opposing free end of the handle portion; and a waterproof pearly layer, which is combined with one surface of the board, the waterproof pearly layer being formed, at a location corresponding to the at least one through hole of the central portion of the board, with at least one waterproof pearly through hole, the at least one waterproof pearly through hole having a hole diameter that is smaller than a hole diameter of the at least one through hole of the central portion of the board, so that a portion of the waterproof pearly layer is suspended over a hole wall of the at least one through hole of the central portion of the board and is foldable to cover the hole wall of the at least one through hole of the central portion of the board, wherein the at least one through hole of the central portion of the board is adapted to receive a cup therein, and the portion of the waterproof pearly layer is located between the cup and the board.

2. The beverage carrying card applicable to cups of various sizes according to claim 1, wherein the board is formed by cutting a cardboard.

3. The beverage carrying card applicable to cups of various sizes according to claim 1, wherein the waterproof pearly layer is made of polyethylene or polypropylene.

4. The beverage carrying card applicable to cups of various sizes according to claim 1, wherein the at least one through hole comprises a plurality of through holes arranged in a lengthwise direction of the central portion and each of the plurality of through holes has a same size.

5. The beverage carrying card applicable to cups of various sizes according to claim 4, wherein each of the plurality of through holes receives a cup therein and each of the cups has a different height.

6. The beverage carrying card applicable to cups of various sizes according to claim 1, wherein a backward folded reinforcement portion is arranged between one end of each of the handle portions that is opposite to the respective one of the sidewall portions and the handle opening of said each of the handle portions.

7. The beverage carrying card applicable to cups of various sizes according to claim 1, wherein a length of each of the handle portions is gradually increased from the one end thereof adjacent to the respective one of the sidewall portions toward an opposite end.

8. The beverage carrying card applicable to cups of various sizes according to claim 1, wherein the waterproof pearly layer is combined with a top surface of the board, and a portion of the waterproof pearly layer that is suspended over the through hole has a length that is greater than a thickness of the board.

9. The beverage carrying card applicable to cups of various sizes according to claim 1, wherein each of the handle portions is formed with two lanyard apertures, and each of the lanyard apertures is connectable with a lanyard.

* * * * *